US006131524A

United States Patent [19]

Nepper, Sr.

[11] Patent Number: 6,131,524

[45] Date of Patent: Oct. 17, 2000

[54] GUARDSMAN SHIELD FOR OPPOSABLY PARRYING A HOSTILE ASSAILANT

[76] Inventor: John P. Nepper, Sr., 9826 Hartman Ave., Omaha, Nebr. 68134

[21] Appl. No.: 09/335,962

[22] Filed: Jun. 18, 1999

[51] Int. Cl.[7] ..... E06B 9/00; F41H 5/08

[52] U.S. Cl. ..... 109/49.5; 89/36.05; 89/36.02

[58] Field of Search ..... 109/49.5; 2/2.5, 2/455; 89/36.05, 36.02; D22/199

[56] References Cited

U.S. PATENT DOCUMENTS

| | | | |
|---|---|---|---|
| 1,250,197 | 12/1917 | Louppe | 109/49.5 |
| 1,279,230 | 9/1918 | Bilan | 109/49.5 |
| 3,370,302 | 2/1968 | Karlyn . | |
| 3,745,938 | 7/1973 | Hathaway et al. | 109/49.5 |
| 4,412,495 | 11/1983 | Sankar | 109/49.5 |
| 4,422,183 | 12/1983 | Landi et al. | 2/2 |
| 4,674,394 | 6/1987 | Martino | 109/49.5 |
| 5,056,155 | 10/1991 | Truxell | 101/49.5 |
| 5,241,703 | 9/1993 | Roberts et al. | 109/49.5 |
| 5,392,686 | 2/1995 | Sankar | 109/49.5 |
| 5,850,052 | 12/1998 | Gabriel | 109/49.5 |

FOREIGN PATENT DOCUMENTS 2221286 1/1990 United Kingdom .

*Primary Examiner*—Darnell Boucher

[57] ABSTRACT

Prior art disclosures include traditional "guardsman shields" for opposably parrying a hostile assailant" and which traditional "shields" and as a main-body extending uprightly along a central vertical-axis and further include horizontally extending upper-edge and lower-edge and vertically extending leftward-edge and rightward-edge, and further with forward-protuberance and rearward anatomical leftward-arm shield guardsman engagement/maneuvable capability. Departing herein from such prior art "guardsman shields" at the main-body thereof are: lower and rearward thighward-engagements to assist guardsman defensive and counter-attach capabilities; and secondary disclosures at main-body rearward flap-like extensions along the main-body upper-edge, lower-edge, and leftward-edge for assistably parrying a forwardly positioned hostile assailant's thrusts toward the guardsman, and forwardly extending from the main-body rightward-edge, an upright forward-flap to defensively parry and offensively protect a guardsman's right-arm counter-attacks maneuvers against a forwardly positioned hostile assailaint.

8 Claims, 6 Drawing Sheets

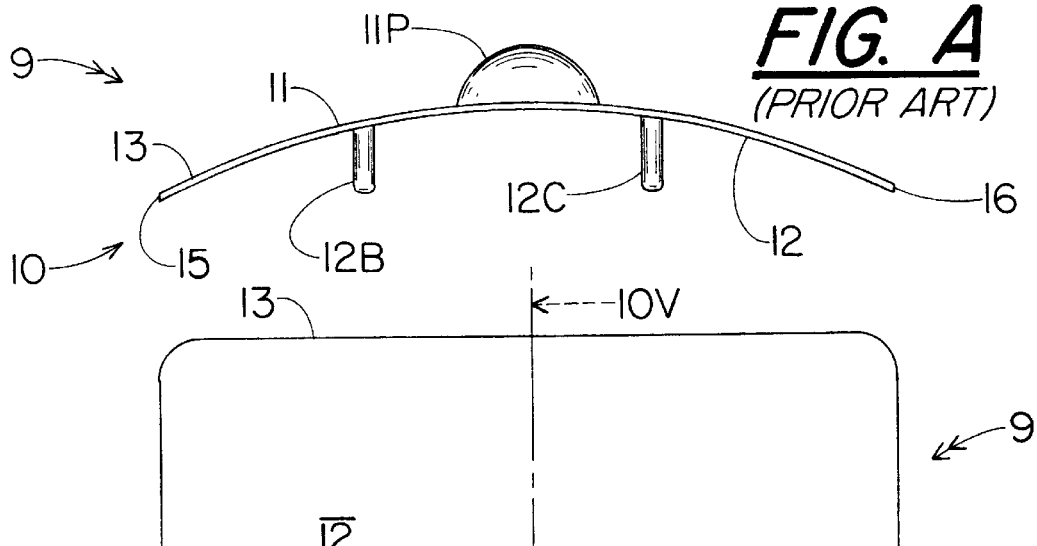
FIG. A
(PRIOR ART)
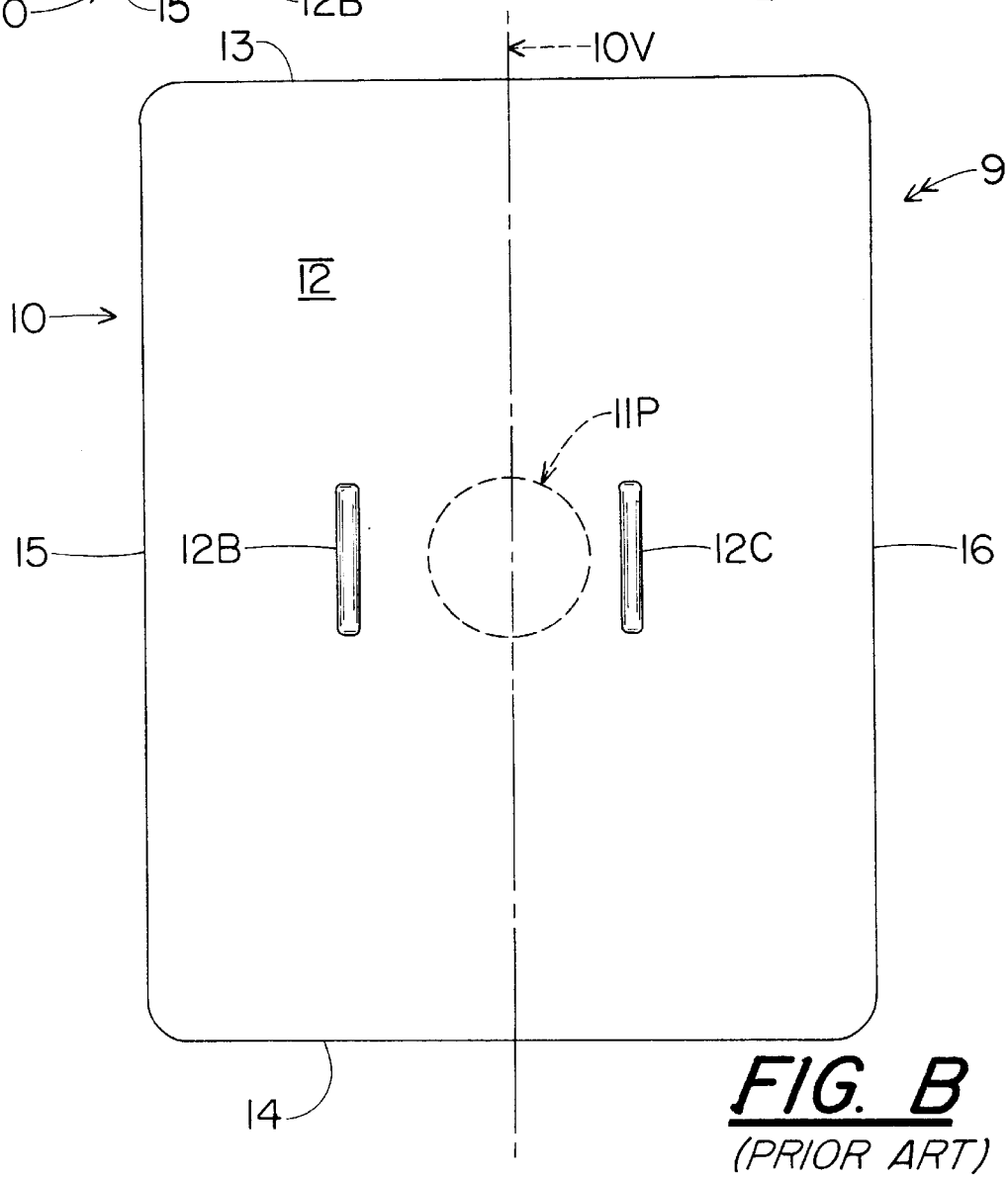
FIG. B
(PRIOR ART)

GUARDSMAN SHIELD FOR OPPOSABLY PARRYING A HOSTILE ASSAILANT

BACKGROUND OF THE INVENTION

As used in the context of the present patent application, the term "guardsman" is defined to mean:

"any person of either gender whose one forearm (usually employed at the rightward-forearm) wields a manually repulsion weapon toward a forwardly-positioned hostile assailant, and whose other forearm (usually employed at the leftward-forearm) wieldably maneuvers an assailant-defensive shield".

In the foregoing regard, the Prior Art appended drawing FIGS. A and B are top-plan and rearward-elevational views, respectively, of rudimentary Prior Art "guardsman shields" incorporating a rudimentary main-body (10) extending uprightly along a central vertical-axis (10V) and which main-body (10) comprises:

(a) generally co-parallel upright forward-surface (11) and rearward-surface (12) and coincidentally therewith:

(a1) extending directionally transversely and generally horizontally perpendicular to said central vertical-axis (10V), uniplanar horizontal upper-edge (13) and uniplanar horizontal lower-edge (14), (a2) extending generally co-parallel to and in directionally transversely opposite flanking relationship with said upright central vertical-axis (10V), a uniplanar upright left-edge (15) and a uniplanar upright right-edge (16);

(b) mounted at and extending rearwardly of the main-body rearward- surface (12) elevationally between upper-edge (13) and lower-edge (14), and respectively flanking central vertical-axis (10V), ulna-encircling leftward-Forearm band (12B) and a leftward-forearm grasp (12C); and (c) mounted to and extending directionally forwardly of the main-body forward-surface (11), and between said elevational edges (13) and (14) and directionally transversely between left-edge (15) and right-edge (16), anti-assailant thrustable shield forward protuberance (11P).

Representative prior art shield embodiment 10 described in said drawing FIGS. A and B are deficient/lacking the following capabilities:

(i) primarily lacks guardsman capability for sufficiently opposably offering shield maneuvarability toward a hostile assailant;

(ii) also lacks sufficient protection to the guardsman's facial areas;

(iii) also lacks guardsman capabilities to sufficiently parry a forwardly positioned hostile assailant's assaults toward the shield's upwardly(13), lower (14), and leftward(15) perimeters; and (iv) also lacks guardsman capability to shield-rightwardly (16) parry a hostile assailant's assaults toward the guardsman's right-arm wielding counter-attack nor to protect the guardsman's counter-attack efforts.

General Objectives of the Present Invention

In view of the foregoing, it is according the General Objective of the present invention to overcome the disadvantages and deficiencies of prior art shields referred to hereabove

General Statement of the Invention

The General Objectives of the Present Invention retains the prior art disclosures alluded to in said drawing FIGS. A and B, but in amplification of the prior art shield main-body (10) has the following structural amplifactions:

(I) in a primary vein, includes , attached to and extending directionally transversely horizontally along the main-body rearward-surface and located adjacently upwardly of the main-body (10) lower-edge (14) and extending a finite-distance rearwardly from the main-body(10) rearward-surface (12),a thighward-engageable means (20), e.g. a lower-bar 21 rearwardly provided with a vertically-extending and medially-located rearward-concavity (22) adapted to nestle a guardsman's anatomical thigh; and (II) in secondary veins include: attached to and extending directionally horizontally along the main-body rearward-surface (12) and located adjacently downwardly of the main-body upper-edge (13) and extending a finite-distance rearwardly from the main-body (10) rearward-surface (12), protection for the guardsman's facial areas;

flap-like extensions respectively rearwardly extending from the main-body upper-edge (13), lower-edge (14) and leftward-edge (15), individually augmenting the guardsman's ability to protectably parry a forwardly positioned hostile assailant's offensive thrusts toward a rearwardly positioned guardsman; and an upright rigntward-flap extending forwardly of the main-body (10) upright rightward-edge (16) for augmenting the guardsman's capability to protectably parry a forwardly positioned hostile assailant's offensive thrusts and for also ancillarily protecting the guardsman's right-arm wielding counter-attacking efforts.

Brief Description of the Drawing

In the drawing, wherein like characters refer to like parts in the several views, and in which.

Drawing FIGS. A and B (aforedescribed) are top-plan and rearward-elevational views, respectively, of a representative and rudimentary prior art "guardsman's shield" (e.g. 9 of FIGS. A and B).

Drawing

Drawing

Drawing

Drawing

Drawing

DETAILED DESCRIPTION OF THE DRAWING

Figure 1:
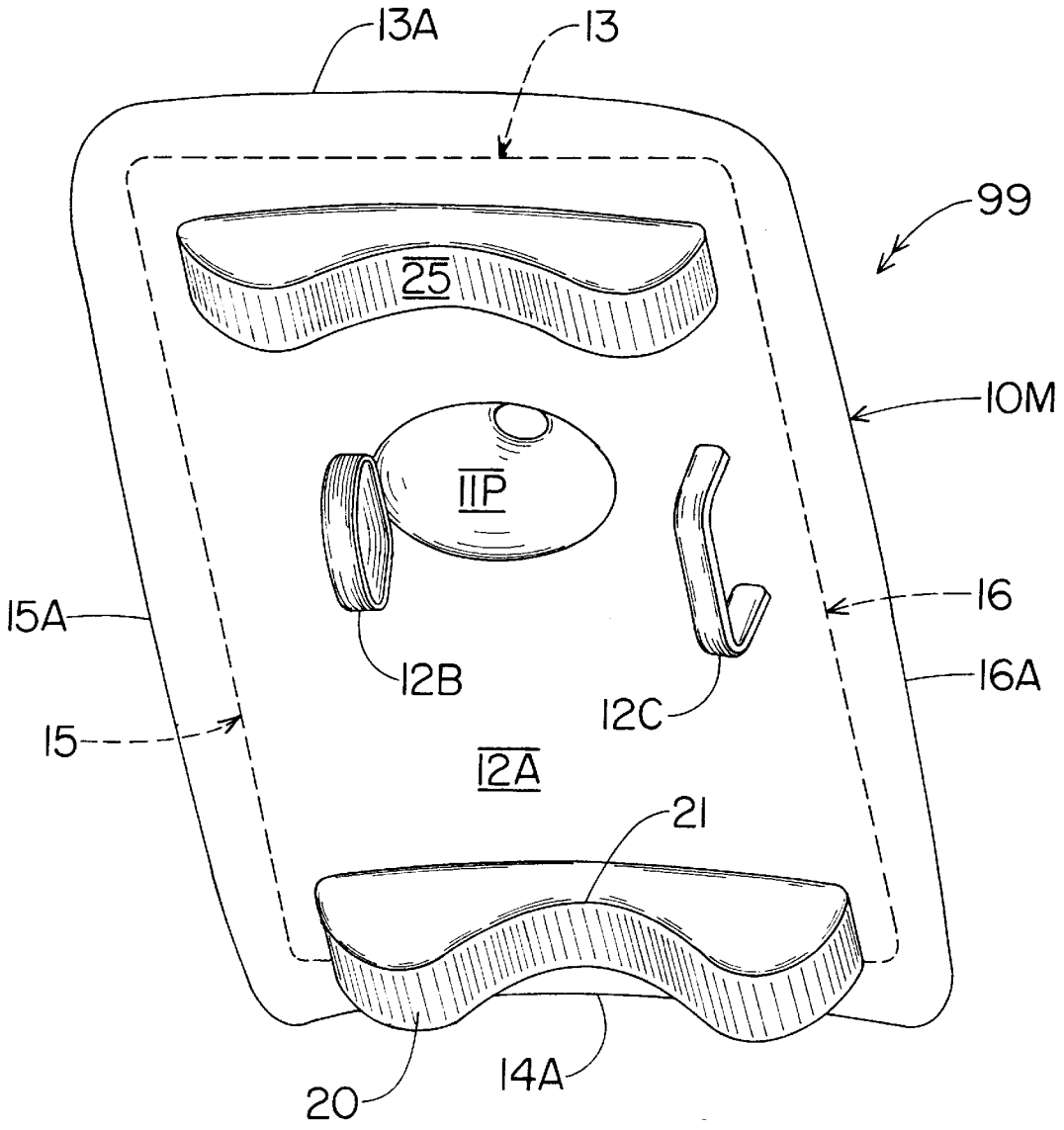
FIG. 1 is a perspective view, taken from the herein described rearward-surface (12A), of a representative embodiment (99) of the improved "guardsman shield" concept of the present invention.
Figure 2:
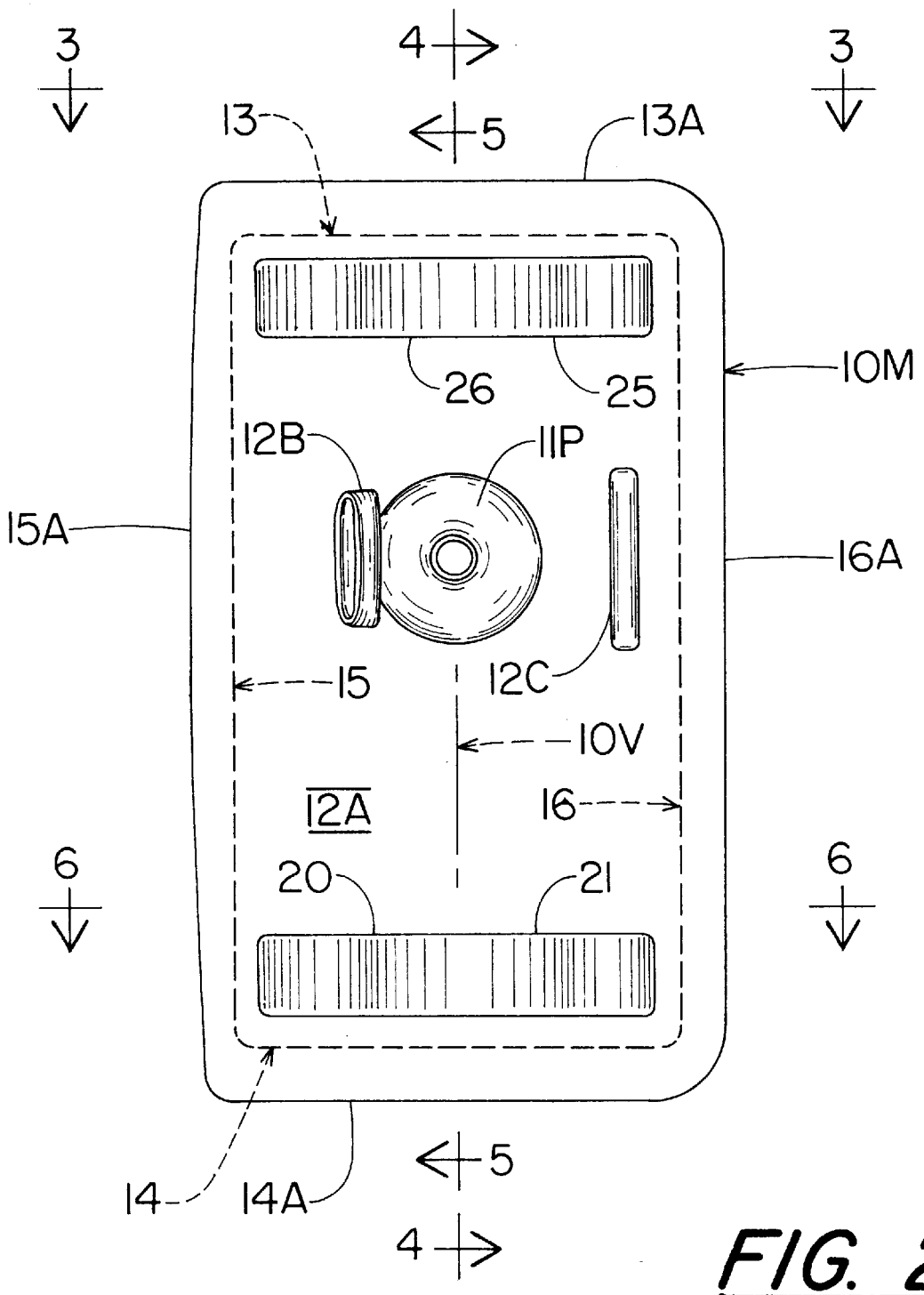
FIG. 2 is a rearward elevational view of the FIG. 1 representative embodiment (99) at its rearward-surface (12A)
Figure 3:
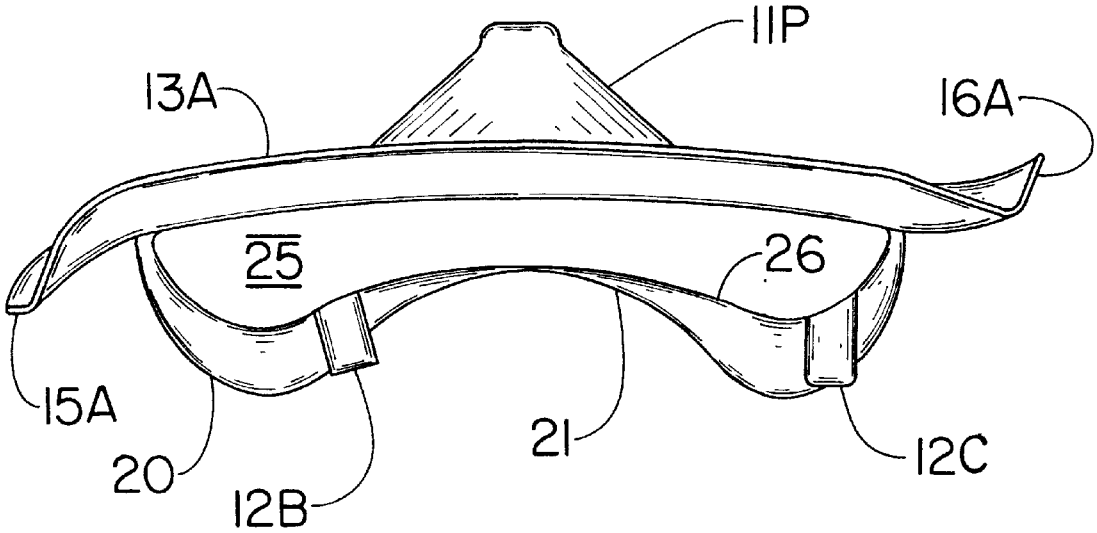
FIG. 3 is a top plan view, taken along line 3—3 of FIG. 2, of the FIGS. 1 and 2 representative embodiment (99)
Figure 4:
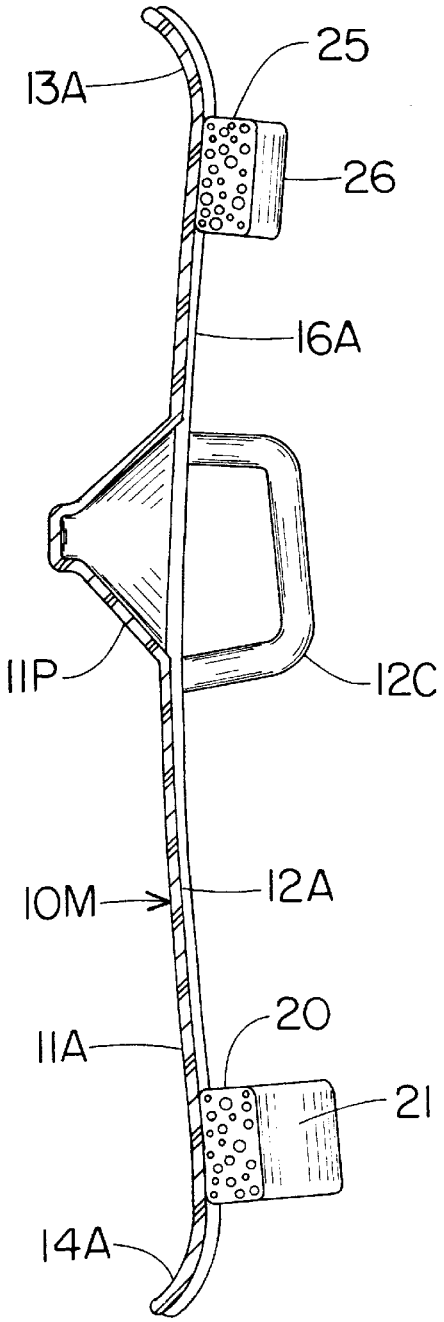
FIG. 4 is a sectional elevational view taken along line 4—4 of FIG. 2.
Figure 5:
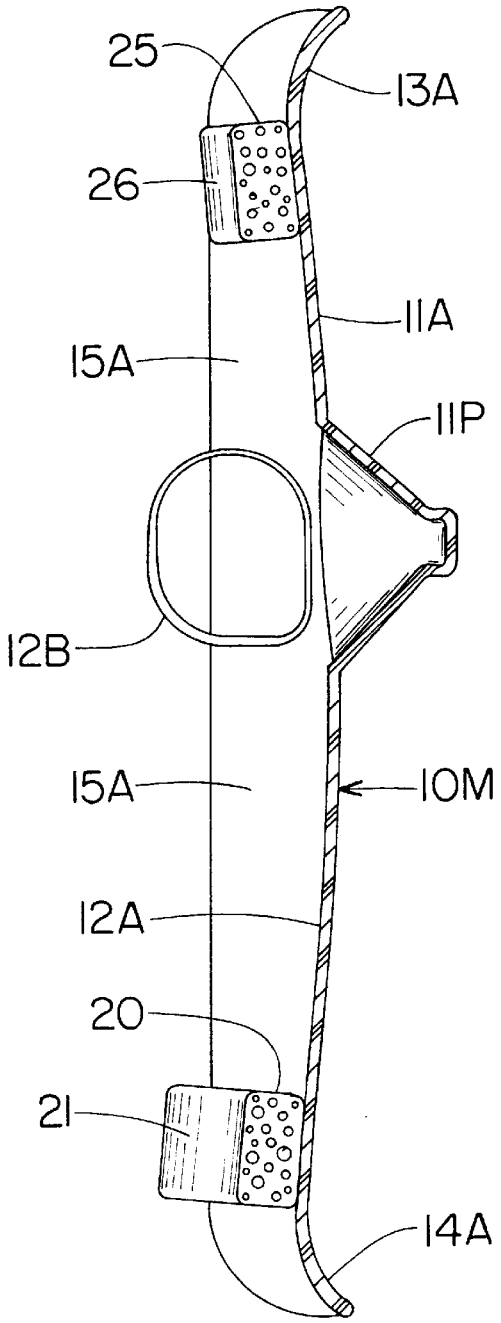
FIG. 5 is a sectional elevational view taken along line 5—5 of FIG. 2; and Drawing
Figure 6:
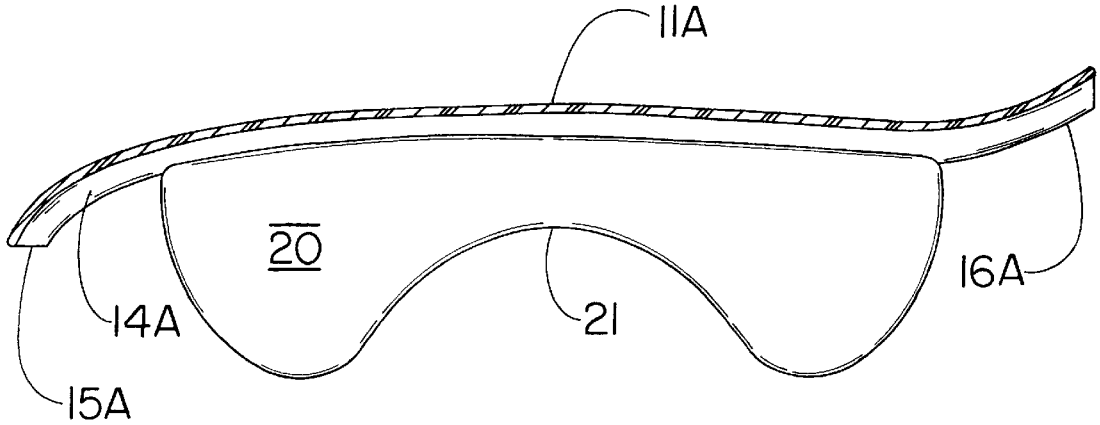
FIG. 6 is a sectional plan view taken along line 6—6 of FIG. 2 and which amplifies, the primarily claimed thighward-engageable means (e.g. 20) for the "guardsman shield" of the present invention.

Representative embodiment (99) of the improved "guardsman shield" of the present invention and as shown in drawing FIGS. 1–6: retains the basic structural features of a prior art main-body (10) at structural features 10V, 11, 11P, 12, 12B, 13, 14, 15, and 16, depicted in and alluded hereabove for the prior art representative embodiment (9) of drawing FIGS. A and B mentioned hereabove; retains the immediately-above recited main-body (10), but in a form 10M that is structurally-continuously formed of an empiricably selectable durable resinous material that incorporates the prior art main-body (10) structural features 11–16 but wherein the frontal-surface (e.g. 11A) is uprightly linearly-generated convex and in parallelism therewith an uprightly linearly-generated concave rearward-surface (e.g. 12A); primarily augmentally discloses, attached to and extending directionally transversely horizontally along the main-body concave rearward-surface (12A), and located adjacently parallel to and immediately above the main-body lower-edge (14) and extending a finite-distance rearwardly therefrom a thighward-engageable means (20) that will be hereafter explained in greater detail; secondarily augmentally discloses, attached to and extending directionally transversely horizontally along the main-body concave rearward-surface (12A) and located adjacently parallel to and immediately below the main-body upper-edge (13) and extending a finite-distance rearwardly therefrom, guardsman facial protection bar-like means (25) provided with a central rearward concavity(26); secondarily augmentally discloses, resinously co-constructbly formed flap-like projections 13A, 14A, and 15A, respectively extending rearwardly from main-body edges 13, 14, and 15, and for enhancing the guardsman's ability to protectably parray a forwardly positioned hostile assailant's thrusts toward a such rearwardly positioned shield-wielding guardsman; and secondarily augmentally discloses, a resinously co-constructably formed forward flap-like projection extending both uprightly and forwardly along the main-body upright rightward-edge (16) to enable (at said rightward-edge flap-like projection 16(A)) to coincidentally parry a forwardly postioned hostile assailant's thrusts and to also protectably enable the guardsman to protectably wieldably counter-attack against a such forwardly positioned hostile assailant.

The lower-bar (20) thighward-engagement means referred to hereabove might take one or more equivalentally opperational forms including, inter alia: provided from a semi-rigid structural material having a central thighward-engageable rearward convex portion (21); contructed throughout of resiliently-compressible structural material that is thighwardly conformable, etc.

In view of the foregoing, the construction and operation of the "guardsman shield for opposably parrying a hostile assailant" will be readily understood and further explanation is believed to be unnecessary. However, it is to be understood that the invention is not to be limited to the particular details shown and described hereabove, except as incorporated in claims made in this patent application.

I claim:

1. Guardsman's shield for opposably parrying a hostile assailant and comprising, in combination:

(A) a main-body structurally-continuously formed of a suitably durable resinous material and said resinous main-body extending uprightly along a central vertical-axis and having: an uprightly linearly-generated concave rearward-surface in parallelism with a convex forward surface, an upright left-edge and an upright right-edge disposed in flanking relationship to said central vertical-axis, and further having an upper-edge and a lower-edge respectively extending directionally transversely perpendicularly horizontally to said central vertical-axis; and (B) rearwardly attached to and extending directionally transversely perpendicularly horizontally along the main body rearward-surface and located adjacently upwardly from the main-body lower-edge and extending a fixed rearward-distance from the main-body rearward-surface, a lower-bar and which directionally transversely horizontally between said main-body left-edge and right-edge is provided with a fixedly and permanently positioned rearward-concavity adapted to maneuverably nestle a guardsman's anatomical thigh and to thereby enable a guardsman to thighably opposably maneuver such guardsman shield in multi-directional parrying defensive orientations toward a hostile assailant.

2. The Guardsman's Shield of claim 1 wherein the main-body upright right-edge is upwardly co-structurally provided therealong with a rightward-flap extending rightwardly and forwardly of said main-body right-edge to protect the guardsman's rightward-arm opposing weapon maneuvers.

3. The Guardsman's Shield of claim 2 wherein the said main-body is resinously co-structurally provided with the following directionally forward extensions:

(i) along the main-body upper-edge, an upper-flap extending also upwardly from the main-body upper-edge, (ii) along the main-body lower-edge, a lower-flap extending also downwardly from the main-body lower-edge, and (iii) along the main-body left-edge, a leftward-flap extending also leftwardly from the main-body left-edge.

4. The Guardsman's Shield of claim 1 wherein said horizontally extending lower-bar is constructed throughout of a resiliently compressible structural material.

5. The Guardsman's Shield of claim 4 wherein the main-body upright right-edge is upwardly co-structurally provided therealong with a vertically-extending rightward-flap extending rightwardly and forwardly of said main-body right-edge to protect the guardsman's rightward-opposing weapon maneuvers.

6. The Guardsman's Shield of claim 5 wherein the said mainbody is resinously co-structurally provided with the following directionally forward extensions:

(i) along the main-body upper-edge, an upper-flap extending also upwardly from the main-body upper-edge, (ii) along the main-body lower-edge, a lower-flap extending also downwardly from the main-body lower-edge, and (iii) along the main-body left-edge, a leftward-flap extending also leftwardly from the main-body left-edge.

7. The Guardsman's Shield of claim 1 wherein there is attached to and extending horizontally along a rearward-surface of said main-body and located adjacently downwardly of its upper-edge and also extending rearwardly thereof, a resiliently-compressible upper-member for protecting the guardsman's facial areas.

8. The Guardsman's Shield of claim 6 wherein there is attached to and extending horizontally along a rearward-surface of said main-body and located adjacently downwardly of its upper-flap and also extending rearwardly thereof, a resiliently-compressible upper-member for protecting the guardsman's facial areas.

* * * * *